US006739520B2

(12) United States Patent
Ohnishi et al.

(10) Patent No.: US 6,739,520 B2
(45) Date of Patent: May 25, 2004

(54) LIQUID INJECTION APPARATUS

(75) Inventors: Takao Ohnishi, Aichi-Prefecture (JP); Toshikazu Hirota, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/262,521

(22) Filed: Oct. 1, 2002

(65) Prior Publication Data

US 2003/0071139 A1 Apr. 17, 2003

(30) Foreign Application Priority Data

| | | |
|---|---|---|
| Oct. 2, 2001 | (JP) | 2001-306385 |
| Nov. 16, 2001 | (JP) | 2001-352166 |
| Feb. 15, 2002 | (JP) | 2002-038411 |

(51) Int. Cl.[7] ..... B05B 1/08

(52) U.S. Cl. ..... 239/102.2; 239/533.1; 239/583; 239/584; 239/585.1; 239/585.4; 239/596; 123/472; 123/498

(58) Field of Search ..... 239/87, 88, 99, 239/101, 102.1, 102.2, 533.1, 533.3, 533.4, 583, 552, 584, 585.1, 585.4, 585.5, 596; 123/446, 472, 478, 497, 498; 251/129.06

(56) References Cited

U.S. PATENT DOCUMENTS

| | | | | |
|---|---|---|---|---|
| 5,437,255 A | * | 8/1995 | Sadley et al. | 123/472 |
| 5,685,485 A | * | 11/1997 | Mock et al. | 239/102.2 |
| 5,766,441 A | | 6/1998 | Arndt et al. | |
| 6,533,197 B1 | * | 3/2003 | Takeuchi et al. | 239/102.2 |

FOREIGN PATENT DOCUMENTS

| | | |
|---|---|---|
| EP | 1 077 089 A | 2/2001 |
| EP | 1 093 837 A | 4/2001 |
| JP | 53 139014 A | 12/1978 |
| JP | 54-090416 | 7/1979 |
| JP | 06-040030 | 2/1994 |

OTHER PUBLICATIONS

Patent Abstracts of Japan, vol. 1999, No. 09, Jul. 30, 1999 & JP 11 107890 A (Nippon Soken Inc; Denso Corp), Apr. 20, 1999 *abstract; figures*.

Patent Abstracts of Japan, vol. 015, No. 232 (M–1124), Jun. 13, 1991 & JP 03 070863 A (Japan Electron Control Syst Co Ltd), Mar. 26, 1991 *abstract; figures*.

Patent Abstracts of Japan, vol. 018, No. 258 (M–1606), May 17, 1994 & JP 06 040030 A (NGK Insulators Ltd), Feb. 15, 1994 *abstract; figures*.

* cited by examiner

*Primary Examiner*—Steven J. Ganey
(74) *Attorney, Agent, or Firm*—Burr & Brown

(57) ABSTRACT

A liquid injection apparatus 10 comprises an injection device 15, and an electro-magnetic injection valve 14 for ejecting pressurized fuel into the injection device. An ejection hole in the electro-magnetic injection valve is connected to a hollow cylindrical hermetically sealed space, which in turn is connected to a liquid ejection nozzle, through a liquid filling port, a liquid supply passage, and a chamber which are included in the injection device. By means of allowing the electro-magnetic injection valve to eject the pressurized fuel at an angle of inclination relative to the center axis of the hollow cylindrical hermetically sealed space, flows of fuel are produced across a wide area in the hermetically sealed space so that large-sized air bubbles are prevented from being formed in the hermetically sealed space. The injection device adds to the liquid an oscillation energy based on a change of volume of the chamber caused by the piezoelectric/electrostrictive element, for atomizing the liquid to be injected.

6 Claims, 8 Drawing Sheets

LIQUID INJECTION APPARATUS

BACKGROUND OF THE INVENTION

1. Field of the Invention

The present invention relates to a liquid injection apparatus for atomizing liquid and injecting the atomized liquid into a liquid injection space.

2. Description of the Related Arts

As such liquid injection apparatuses, a fuel injection apparatus for an internal-combustion engine is known. The fuel injection apparatus for the internal-combustion engine is a so-called electrically controlled fuel injection apparatus comprising a pressurizing pump for pressurizing liquid and an injection valve, and has been widely and practically in use. However, as the electrically controlled fuel injection apparatus is configured in such a manner that the fuel pressurized by the pressurizing pump is injected from the injection port of the electromagnetic injection valve, the droplet size of the injected fuel is relatively large, about 100 μm at minimum, and further the sizes are not uniform. Such large droplet sizes or uneven droplet sizes of the fuel increase incomplete combustion of fuel when the fuel is burned, thereby causing the increase in toxic emission.

On the other hand, as Japanese Patent Application Laid-open (kokai) No. 54-90416 discloses, a droplet eject apparatus is proposed, wherein the liquid in a liquid supply passage is pressurized by operation of a piezoelectric element to produce ultra-fine droplets of liquid and these droplets of liquid are ejected from an eject port. Apparatuses of the type described use the principle of the ink jet eject apparatus disclosed, for example, in Japanese Patent Application Laid-open (kokai) No. Hei6-40030, or others. In the apparatus, the size of the ejected droplet (the droplet of injected fuel) can be reduced and can be uniform, when compared to the above-mentioned electrically controlled fuel injection apparatus. Therefore, this apparatus can be said to be an excellent apparatus in atomizing fuel.

When the ink jet eject apparatus is used under a relatively steady-state environment with less change in the temperature or pressure (for example, in an office room, or school), it can give its intended performance to inject liquid in the form of droplets of liquid. However, if it is used under such an environment that fluctuates heavily caused by fluctuation of operating conditions, like an internal-combustion engine, it is generally difficult for the apparatus to fully give its intended performance to atomize the fuel. Therefore, no liquid (fuel) injecting apparatus has so far been provided which fully succeeds in atomizing liquid and injecting the liquid in the form of droplets of liquid, by means of using the principle of the ink jet eject apparatus, for a mechanical apparatus with heavily fluctuating environment like an internal-combustion engine.

When such a liquid injection apparatus is applied to mechanical apparatuses like an internal-combustion engine, the liquid injection apparatus is required to securely and stably supply the amount of injection of the liquid required by the mechanical apparatus, and at the same time, to inject the liquid at the injection timing required by the mechanical apparatus without delay. However, since such liquids injecting apparatuses carry out injecting by means of increasing or reducing the pressure of liquid, air bubbles are easily formed in the liquid, and if such air babbles are not removed before they become large, the pressure of the liquid cannot be increased as expected. Therefore, the apparatus cannot satisfy the requirements as to the amount of injection and the injection timing.

SUMMARY OF THE INVENTION

It is therefore the object of the present invention to provide a liquid injection apparatus capable of stably accomplishing atomization of liquid and injecting the liquid in the form of uniform minute droplets of liquid. Another object of the present invention is to provide a liquid injection apparatus, which is configured to have the capability of stably injecting liquids even under conditions that the use environment for the liquid injection apparatus such as liquid injection space heavily and suddenly fluctuates. A further object of the present invention is to provide a liquid injection apparatus, which can inject the intended amount of injection of liquid at the intended injection timing, by means of preventing air babbles from being formed in the liquid within the liquid injection apparatus.

In order to achieve the above objects, according to a first aspect of the present invention, there is provided a liquid injection apparatus comprising an injection device including a liquid ejection nozzle having one end exposed to a liquid injection space, a piezoelectric/electrostrictive element, a chamber connected to the other end of the liquid ejection nozzle, the chamber having a volume changed by the operation of the piezoelectric/electrostrictive element, a liquid supply passage connected to the chamber, and a hollow cylindrical liquid filling port allowing the liquid supply passage to communicate with the exterior; pressurizing means for pressurizing liquid; an electromagnetic ejection valve to which liquid pressurized by the pressurizing means is supplied, the electro-magnetic ejection valve including a solenoid valve and an ejection hole which is opened or closed by the solenoid valve, the electromagnetic ejection valve ejecting the pressurized liquid through the ejection hole when the solenoid valve is opened; and a hermetically sealed space forming member for forming a hollow cylindrical hermetically sealed space between the ejection hole of the electro-magnetic ejection valve and the liquid filling port of the injection device, the hermetically sealed space having substantially the same diameter as the diameter of the liquid filling port; liquid ejected from the electro-magnetic ejection valve being atomized by change of volume of the chamber and injected in the form of droplets from the liquid ejection nozzle into the liquid injection space, wherein the electro-magnetic ejection valve is configured to eject liquid ejected from the ejection hole in a direction having a predetermined angle relative to a center axis of the hollow cylindrical hermetically sealed space, such that the distance of the liquid from the center axis increases accordingly as the distance from the ejection hole toward the liquid filling port increases.

By virtue of such a configuration, the liquid pressurized by the pressurizing means is ejected from the electromagnetic ejection valve into the injection device, and then the liquid is injected from the liquid ejection nozzle with being atomized by means of volume change of the chamber in the injection device.

In this case, the size of the atomized droplet varies depending on physical properties, such as a pressure to be applied to the liquid, an amplitude and/or a frequency of the vibration caused by the piezoelectric/electrostrictive element, the shape and/or dimension of a flow path, and the viscosity/surface tension of the liquid. However, if the period of vibration applied to the liquid is smaller than the time required for the liquid, in the vicinity of the end portion of the liquid ejection nozzle (the opening exposed to the liquid injection space), to travel by the length equivalent to the diameter of the end portion of the liquid ejection nozzle, the size of the droplet to be ejected is almost less than the diameter of the end portion of the liquid ejection nozzle. Therefore, for example, if the diameter of the end portion (opening) of the liquid ejection nozzle exposed to the liquid injection space is designed to be less than tens of μm's, the liquid injection apparatus will be able to inject droplets of liquid which are atomized (formed) into extremely uniform small pieces, and, for example, if the apparatus is used as a fuel injection apparatus for an internal-combustion engine, the fuel consumption of the internal-combustion engine can be improved and toxic emission can be reduced, as the apparatus can atomize (form) the injecting fuel into droplets of liquid having an appropriate diameter.

Moreover, according to the above-mentioned configuration, since the pressure required for injecting liquid is generated by pressurizing means, the apparatus can stably inject and supply the liquid in the intended form of very small particles, even if the environment for the liquid injection space (for example, the pressure and temperature) is abruptly changed due to changes in operating conditions for the machine to which the apparatus is applied.

Furthermore, in the conventional carburetor, the flow rate of the fuel (liquid) is determined corresponding to the flow rate of the air in the space within the intake pipe, that is the liquid droplet ejecting space, and the degree of atomization varies depending on the flow rate of the air, however, the liquid injection apparatus according to the present invention can eject only the required amount of the fuel (liquid) which keeps satisfactory atomized state, regardless of the flow rate of the air. In addition, the liquid injection apparatus according to the present invention does not require a compressor for supplying assist air, unlike the conventional apparatuses which promote the atomization of the fuel by means of supplying assist air to the nozzle of the fuel injector. This is one of the reasons for the possibility of embodying the apparatus at low cost according to the apparatus of this invention.

Also, in the above-mentioned configuration, between the ejection hole in the electromagnetic ejection valve and the liquid filling port in the injection device, a hollow-cylindrical hermetically sealed space is formed, which has substantially the same diameter as the liquid filling port, and the shape of which is a hollow cylinder, by the hermetically sealed space forming member, and the liquid from the ejection hole is ejected in the direction having a predetermined angle to the center axis (of the hollow-cylindrical hermetically sealed space), so that the distance of the liquid (droplets) from the center axis of the hollow cylindrical hermetically sealed space increases, as the distance from the ejection hole to the liquid filling port increases.

As a result, as the flow of the ejected liquid is generated in a wide area of the hollow cylindrical hermetically sealed space, air bubbles are particularly hard to stay in corners in the vicinity of the ejection hole in the electro-magnetic ejection valve in the hollow cylindrical hermetically sealed space, or air bubbles formed at the corners are easily and promptly removed, before they become larger. Therefore, in this liquid injection apparatus, since the pressure rise of the liquid is hardly hindered by air bubbles, the pressure of the liquid can be increased as expected, and the apparatus can inject the required amount of droplets of liquid at the required injection timing according to the requirements of mechanical apparatuses.

In this case, the preferred angle formed between the flow line of the droplets of liquid ejected from the eject port and the axis of the hollow cylindrical hermetically sealed space, i.e., the predetermined angle θ is preferably 5° or more and 30° or less.

In other words, if the predetermined angle θ is smaller than 5°, since fluid (including air) is easily stay at corners in the vicinity of the electro-magnetic ejection valve in the hollow cylindrical hermetically sealed space, air bubbles are easily formed at the corners, and on the contrary, if the predetermined angle θ is larger than 30°, the substantial traveling distance of the liquid ejected from the ejection hole till it arrives at the liquid supply passage becomes long, thereby retarding the rise of the liquid pressure in the liquid supply passage, and consequently making it difficult for the ejection nozzle to inject droplets of liquid at the intended injection timing.

Preferably, by the time when liquid ejected from the electromagnetic ejection valve is injected through the ejection nozzle into the liquid injection space, a flow of the liquid is bent at substantially right angles at least once.

Such a configuration can be embodied, for example, by means of arranging a liquid filling port and a liquid supply passage such that the flowing direction of the liquid which passes through the liquid filling port intersects the flowing direction of the liquid which passes through the liquid supply passage at right angles, and also arranging the liquid supply passage and a chamber such that the liquid which passes through the liquid supply passage is introduced into the chamber after being bent at generally right angles, or arranging the chamber and the ejection nozzle such that the liquid which passes through the chamber is bent at generally right angles and flows into the ejection nozzle.

According to configurations of the type described, as the flow of the liquid ejected from the electro-magnetic ejection valve is bent at generally right angles at least once, the pulsation of the liquid pressure within the injection device incidental to the opening operation of the electro-magnetic ejection valve is reduced, and/or the distribution of liquid pressure in the injection device becomes equalized (the liquid pressure is distributed equally), the apparatus can stably inject droplets of liquid. Especially, when the injection device has a plurality of chambers connected to a common liquid supply passage, if the flow of the liquid ejected from the electro-magnetic ejection valve is bent at generally right angles by the liquid filling port and the liquid supply passage, the pressure of the liquid within the liquid supply passage will be stabilized, and the pressure of the liquids within the individual chambers will also be stabilized, thus resulting in acquisition of equal sizes of droplets of liquid ejected from the ejection nozzle connected to the chambers.

The liquid supply passage preferably includes a plane section which is opposed to (confronts) a virtual plane defined by a section at which the liquid supply passage is connected to the liquid filling port, the plane section extending in parallel with the virtual plane, and the electro-magnetic ejection valve is preferably arranged such that an ejection flow line of liquid ejected from the ejection hole intersects the plane section of the liquid supply passage without intersecting a side wall of the hollow cylindrical hermetically sealed space formed by the hermetically sealed space forming member, or a side wall which is created by virtually extending the side wall of the hermetically sealed space down to the plane section of the liquid supply passage.

According to this configuration, as the liquid ejected from the electro-magnetic ejection valve arrives at the plane section of the liquid supply passage with keeping its kinetic energy (flow velocity) in high state, the liquid is strongly reflected in the plane section toward the filling port and the vicinity side of the ejection hole in the hollow cylindrical hermetically sealed space formed by the hermetically sealed space forming member. As a result, since the flow of the reflected liquid can remove air bubbles staying at corner sections in the vicinity of the ejection hole in the hollow cylindrical hermetically sealed space, the amount of air bubbles in the liquid can be reduced. Accordingly, in the liquid injection apparatus, since it will be much more difficult for air bubbles to hinder the rise of the liquid pressure, and the pressure of the liquid can be increased as expected, the liquid injection apparatus can inject the specified amount of liquid in the form of droplets of liquid at the specified injection timing, as mechanical apparatuses require.

Preferably, the ratio (V/Q) is 0.03 or less where V represents a volume (cc) of a liquid flow passage extending from the electro-magnetic ejection valve (portion of the ejection hole) up to the leading end of the ejection nozzle of the injection device, and Q represents the quantity of ejection per unit time (cc/minute) of liquid ejected from the electromagnetic ejection valve.

Here, the fluid volume formed from the electro-magnetic ejection valve to the leading end of the ejection nozzle of the injection device means the total volume of the hermetically sealed space for the hermetically sealed space forming member, liquid filling port, liquid supply passage, chamber and liquid ejection nozzle (in the case where the liquid supply passage and the chamber are connected with a liquid introduction hole, the volume of the liquid introduction hole is included in the total volume).

The reason for setting the size of the ratio (V/Q) as described above, is that if the ratio (V/Q) is larger than 0.03, the volume V (cc) becomes excessively large to the flow rate Q (cc/minute), and the time period between the timing when the device starts ejecting the liquid by the electro-magnetic ejection valve and the timing when the pressure of the liquid within the ejection nozzle in the injection device starts rises becomes too long, thereby causing a difficulty in injecting droplets of liquid at the intended timing.

In order to attain the above objects, according to a second aspect of the present invention there is provided a liquid injection apparatus comprising an injection device including a liquid ejection nozzle having one end exposed to a liquid injection space, a piezoelectric/electrostrictive element operated by a drive voltage signal, a chamber connected to the other end of the liquid ejection nozzle, the chamber having a volume changed by the operation of the piezoelectric/electrostrictive element, a liquid supply passage connected to the chamber, and a liquid filling port allowing the liquid supply passage to communicate with the exterior; pressurizing means for pressurizing liquid; an electromagnetic ejection valve to which liquid pressurized by the pressurizing means is supplied, the electro-magnetic ejection valve including a solenoid valve driven by a valve drive signal and an ejection hole which is opened or closed by the solenoid valve, the electro-magnetic ejection valve ejecting the pressurized liquid through the ejection hole into the liquid filling port of the injection device when the solenoid valve is driven; and an electric control unit including drive voltage signal generation means for generating the drive voltage signal, and valve drive signal generation means for generating the valve drive signal; liquid ejected from the electromagnetic ejection valve being atomized by change of volume of the chamber and injected in the form of droplets from the liquid ejection nozzle into the liquid injection space, wherein the electric control unit is configured to start generating the drive voltage signal at a point of time prior to the time when the pressure of liquid within the liquid supply passage starts to rise as a result of generation of the valve drive signal.

By virtue of this configuration, at the instant when the pressure of the liquid within the liquid supply passage starts rising by the generation of the valve drive signal, i.e., at the instant when the ejection nozzle in the injection device likely starts injecting droplets of liquid, the piezoelectric/electrostrictive element is already driven by the drive voltage signal, and oscillation energy (vibration energy) is added to the liquid, therefore, the device can securely inject atomized droplets of liquid from the beginning of injecting liquid.

Similarly, according to a third aspect of the present invention, the electric control unit is configured to continue generation of (i.e. to generate) the drive voltage signal till a point of time posterior to the time when the valve drive signal comes to an end.

By virtue of this configuration, since the pressure of the liquid within the liquid supply passage is kept higher than the pressure required for injecting for a while even after the valve drive signal is ended, at the instant when the ejection nozzle in the injection device keeps injecting droplets of liquid, the piezoelectric/electrostrictive element is still driven by the drive voltage signal, and oscillation energy is still applied to the liquid. Therefore, the device can securely atomize and inject the liquid, (until the injection actually stops) even after the valve drive signal is ended.

Preferably, the injection device comprises a plurality of the liquid ejection nozzles such that the directions of injection of liquid droplets injected from the plurality of liquid ejection nozzles are parallel to each other.

According to this, the droplets of liquid ejected from the individual ejection nozzle to the liquid injection space will not cross each other, so that droplets of liquid can be prevented from becoming large by colliding with each other, and the satisfactory atomizing state of injecting droplets of liquid can be maintained.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE INVENTION

Figure 1:
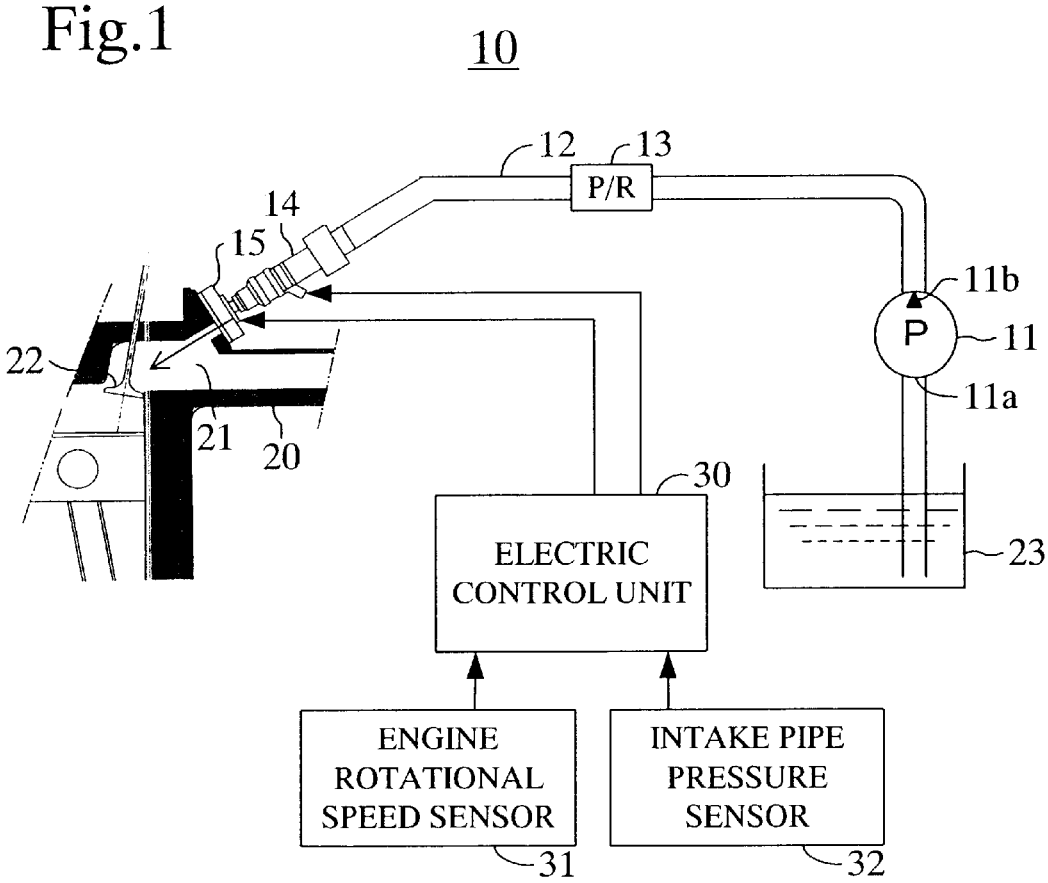
FIG. 1 is a schematic view of a liquid injection apparatus applied to an internal-combustion engine with respect to an embodiment of the present invention.

With reference to the drawings, description will now be made of embodiments of a liquid injection apparatus (liquid spraying apparatus, liquid supplying apparatus, liquid droplet ejecting apparatus) in accordance with the present invention. FIG. 1 shows a schematic configuration for the liquid injection apparatus applied to an internal-combustion engine as a mechanical apparatus, which requires atomized liquid.

This liquid injection apparatus 10 is an apparatus for injecting atomized liquid (liquid-fuel, for example, gasoline, hereinafter it may be simply referred to as "fuel") into a fuel injecting space 21 formed by an intake pipe (or a suction port) 20 in an internal-combustion engine, toward the back face of an intake valve 22 for the internal-combustion engine, and comprises a pressurizing pump (fuel pump) 11 as pressurizing means, a liquid supply pipe (fuel piping) 12 provided with (or pipe 12 having therein) the pressurizing pump, a pressure regulator 13 provided on the eject side of the pressurizing pump of the liquid supply pipe 12, an electro-magnetic ejection valve 14, an injecting unit (spraying unit) 15 having a chamber, at least a piezoelectric/electrostrictive element being formed on its wall face, for atomizing the liquid to be injected into the fuel injecting space 21 and an ejection nozzle, and an electric control unit 30 which supplies an valve drive signal and a drive voltage signal for changing the volume of the chamber (for operating the piezoelectric/electrostrictive element), to the electro-magnetic ejection valve 14 and the injecting unit 15, respectively, as drive signals.

The pressurizing pump 11 is connected to the bottom section of a liquid storage tank (fuel tank) 23, and comprises a lead-in section 11*a*, to which the fuel is supplied from the liquid storage tank 23, and an eject section 11*b*, which is connected to the liquid supply pipe 12. This pressurizing pump 11 introduces the fuel in the liquid storage tank 23 through the lead-in section 11*a*, and pressurizes the fuel so that the pressure of the fuel can become larger (to obtain a pressure larger) than the pressure required for injecting droplets of liquid into the liquid injection space 21 (this pressure is called "eject pressure of pressurizing pump) through the pressure regulator 13, electromagnetic ejection valve 14 and injecting unit 15 (even if the piezoelectric/electrostrictive element of the injecting unit 15 is not operated), and then ejects the pressurized fuel from the eject section 11*b* into the liquid supply pipe 12.

The pressure within the intake pipe 21 is given to the pressure regulator 13 by piping which is not shown in the drawing, and based on this given pressure, the pressure regulator 13 is configured so as to reduce (or regulate) the pressure of the fuel pressurized by the pressurizing pump 11 to adjust the pressure of the fuel within the liquid supply pipe 12 at the position between the pressure regulator 13 and the electro-magnetic ejection valve 14 in order to make the pressure higher than the pressure within the intake pipe 21 by the specified (constant) pressure (this adjusted pressure is called "regulated pressure"). As the result of this configuration, when the electro-magnetic ejection valve 14 is opened for the specified time, the fuel is injected into the intake pipe 21 regardless the pressure within the intake pipe 21, by the fuel amount which is generally in proportion to the specified time.

Figure 2:
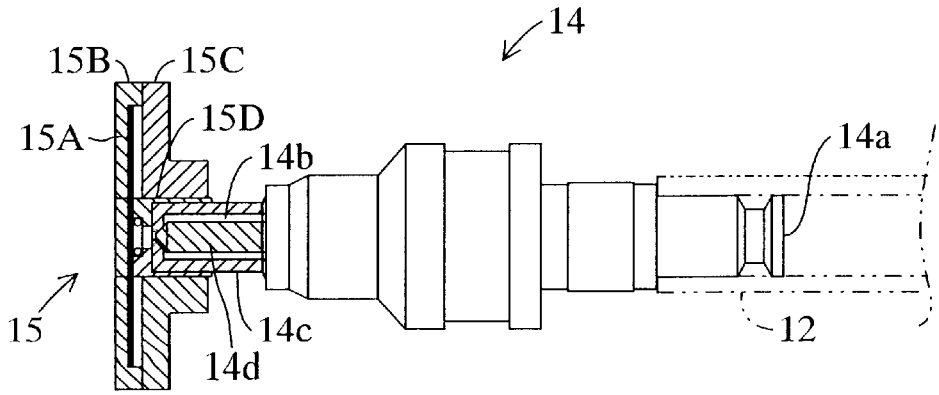
FIG. 2 is a diagram showing an electro-magnetic ejection valve and an injecting unit shown in FIG. 1.
Figure 3:
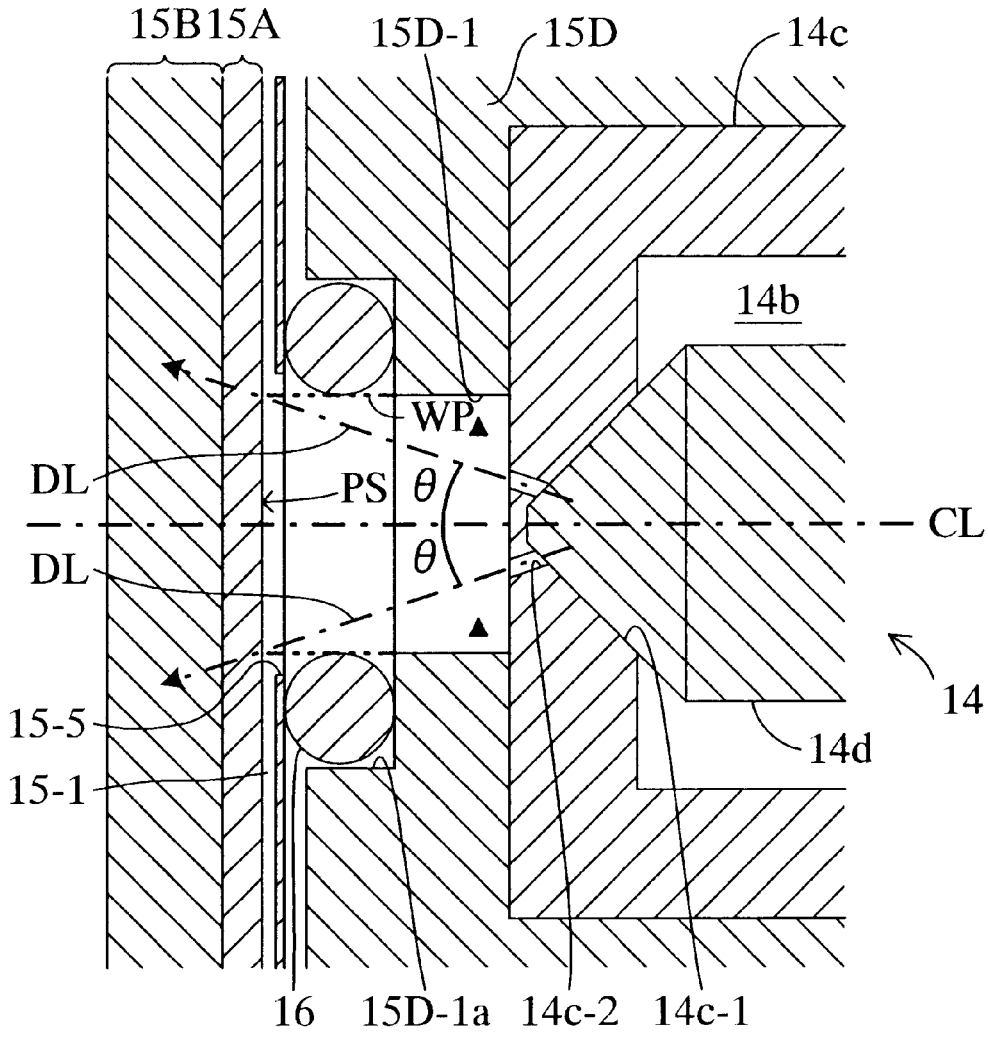
FIG. 3 is an enlarged cross-sectional view of the electro-magnetic ejection valve and the injecting unit in the vicinity of the leading end portion of the electro-magnetic ejection valve shown in FIG. 2.

The electro-magnetic ejection valve 14 is a conventionally well-known fuel injector (electro-magnetic injection valve), which has been widely adopted in an electrically controlled fuel injection apparatus for an internal-combustion engine. FIG. 2 is a front view of the electro-magnetic ejection valve 14, showing a cross-section formed by cutting through the leading end of the ejection valve by a plane including the center line of the electro-magnetic ejection valve 14, and also showing a cross-section formed by cutting through by the same plane as the above the injecting unit 15 secured to the electro-magnetic ejection valve 14. Also, FIG. 3 is an enlarged cross-sectional view of the electro-magnetic ejection valve 14 and the injecting unit 15 in the vicinity of the leading end of the electro-magnetic ejection valve 14 shown in FIG. 2.

As shown in FIG. 2, this electromagnetic ejection valve 14 comprises a liquid lead-in port 14*a* connected to the liquid supply pipe 12, an external barrel 14*c* forming a fuel passage 14*b* linking to (communicating with) the liquid lead-in port 14*a*, a needle valve 14*d* which functions as a solenoid valve, and an electromagnetic mechanism for driving the needle valve 14*d*, which is not shown in the drawing. As shown in FIG. 3, a conical-shape valve seat 14*c*-1, the shape of which is generally the same as the leading end of the needle valve 14*d*, is provided on the center of the leading end of the external barrel 14*c*, and also, a plurality of ejection holes 14*c*-2 (through holes), which make the inside of the external barrel 14*c* (i.e. the fuel passage 14*b*) communicate with the outside of the external barrel 14*c*, are provided in the vicinity of the top (leading end) of the valve seat 14*c*-1. These ejection holes 14*c*-2 are tilted by the angles θ to the axis CL of the needle valve 14*d* (i.e. to the axis CL of the electromagnetic ejection valve 14). Although not shown in the drawing, when the external barrel 14*c* is viewed from the direction along the axis CL, the plurality of ejection holes 14*c*-2 are arranged on the circumference of the same circle at (with) a constant interval.

According to the above-mentioned configuration, in the electromagnetic ejection valve 14, the needle valve 14*d* is driven by the electromagnetic mechanism and opens or closes the ejection hole 14*c*-2, and when the ejection hole 14*c*-2 is opened, the fuel in the fuel passage 14*b* is ejected (injected) through the ejection hole 14*c*-2. The fuel to be ejected as described above is injected as if spreading along the side face of a cone with the axis CL as its center (i.e. outer side face of the shape formed by the ejected liquid becomes substantially a cone), because the ejection hole 14-2*c* is tilted to the axis CL of the needle valve 14*d*.

As shown in FIG. 2, the injecting unit 15 includes an injection device 15A, an injection device stationary plate 15B, a retainer unit 15C for retaining the injection device stationary plate 15B, and a sleeve 15D for securing the leading end of the electro-magnetic ejection valve 14.

Figure 4:
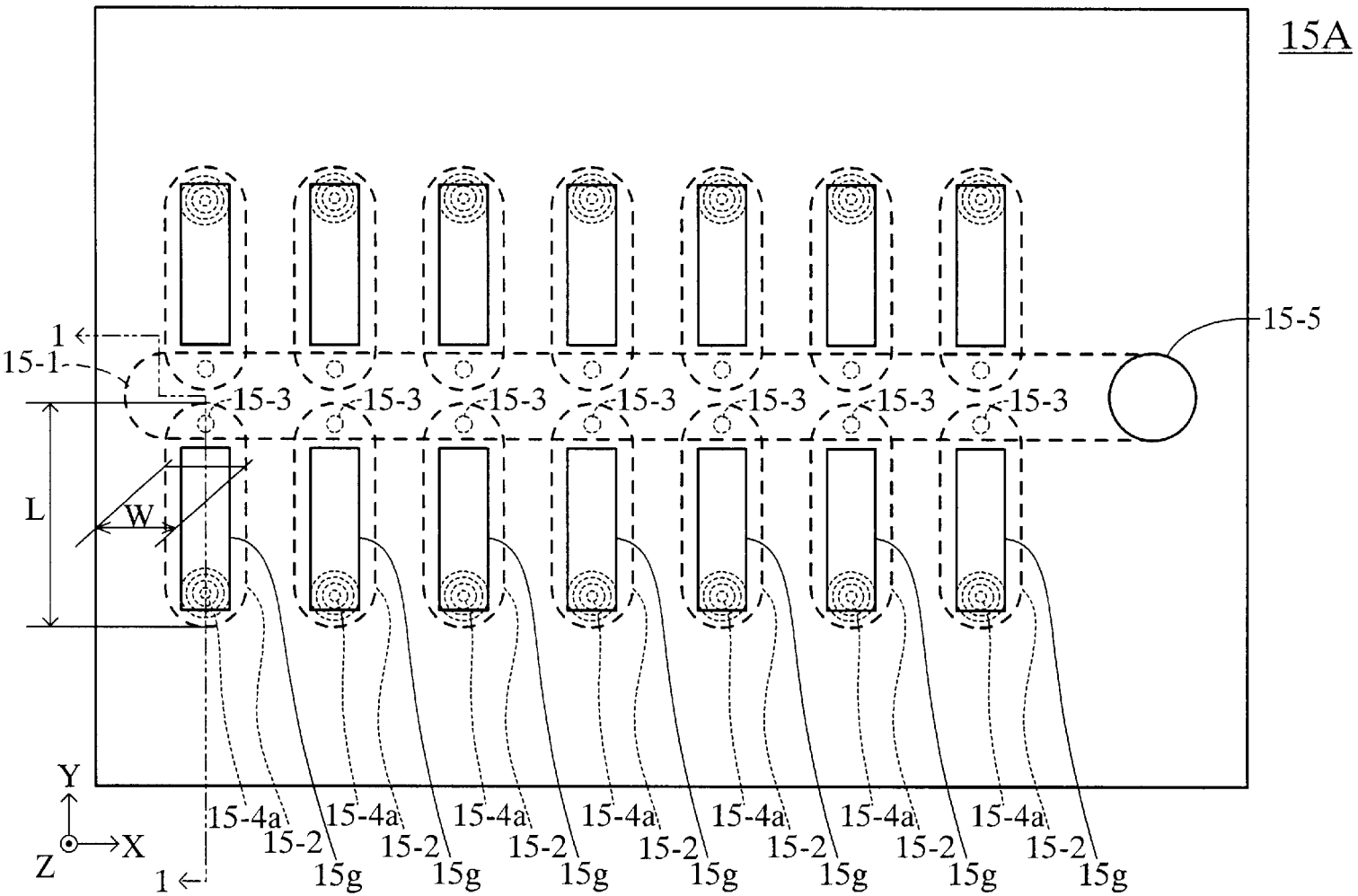
FIG. 4 is a plan view of the injection device shown in FIG. 2.
Figure 5:
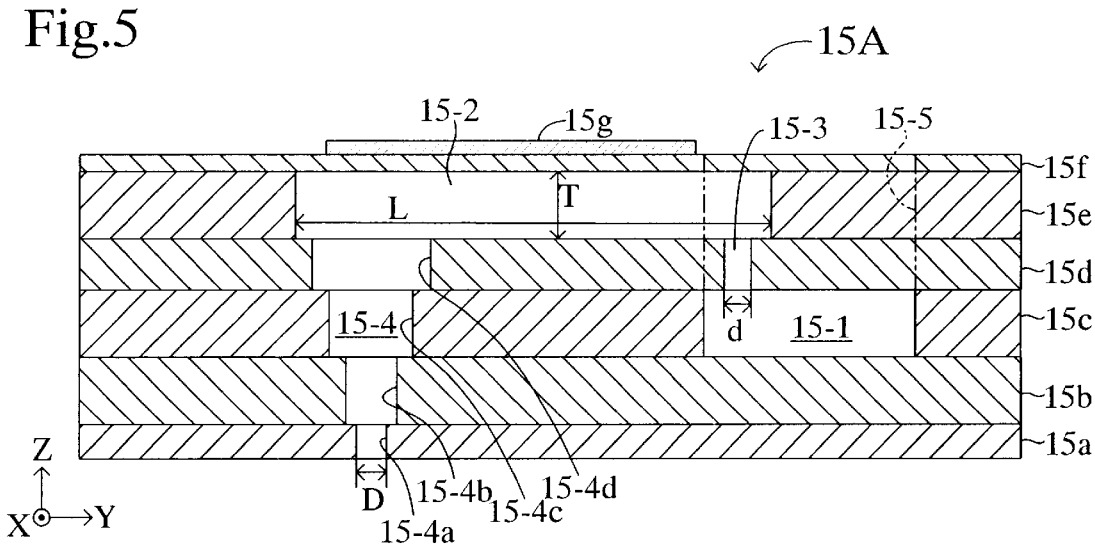
FIG. 5 is a cross-sectional view when the plane along the line 1—1 shown in FIG. 4 cuts through the injection device.

As shown in FIG. 4 which is a plan view of the injection device 15A and in FIG. 5 which is a cross-sectional view taken along the line 1—1 noted in FIG. 4, the injection device 15 has the shape of a substantially rectangular solid, each side of which extends in parallel to the X, Y or Z axis crossing each other at right angles. The injection device 15 comprises a plurality of ceramic thin plates 15*a*–15*f* (hereinafter to be referred to as "ceramic sheets") that are sequentially laminated (layered in order) and compression bonded (bonded by pressure), and a plurality of piezoelectric/electrostrictive elements 15*g* secured to the outer side face (plane along the X-Y plane in the positive direction of Z axis) of the ceramic sheet 15*f*. This injection device 15A includes a liquid supply passage 15-1, a plurality of chambers 15-2 which are independent from each other (here, 7 pieces for each line, 14 pieces in total), a plurality of liquid introduction holes 15-3 which make each of the chambers 15-2 communicate with the liquid supply passage 15-1, a plurality of liquid ejection nozzles 15-4, one end of which is substantially exposed to a liquid injection space 21 so that each of the chambers 15-2 can communicate with the outside of the injection device 15A, and a liquid filling port 15-5, inside it.

The liquid supply passage 15-1 is a space defined by the side wall face of an elliptic (elongated circle-shaped) cut, formed in the ceramic sheet 15*c*, with its longer axis and shorter axis running along the X axis direction and the Y axis direction, respectively, the upper face which is the plane of the ceramic sheet 15*b*, and the lower face which is the plane of the ceramic sheet 15-*b*.

Each of the plurality of chambers 15-2 is a longitudinal space (a liquid flow passage having a longitudinal direction) defined by the side wall face of an elliptic (elongated circle-shaped) cut, formed in the ceramic sheet 15-*e*, with its longer axis and shorter axis running along the Y axis direction and X axis direction, respectively, the upper face of the ceramic sheet 15*d*, and the lower face of the ceramic sheet 15*f*. One end in the Y axis direction of each of the chambers 15-2 extends up to the upper section of the liquid supply passage 15-1, and by means of using this one end, each of the chambers 15-2 is connected to the liquid supply passage 15-1 through the hollow cylindrical liquid introduction hole 15-3 with the diameter d provided in the ceramic sheet 15*d*. Hereinafter, the diameter d is also to be simply referred to as "introduction hole diameter d." The other end in the Y-axis direction of each of the chambers 15-2 is connected tote other end of the liquid ejection nozzle 15-4. According to the above-mentioned configuration, through and in the chamber 15-2 (flow passage), the liquid flows from the liquid introduction hole 15-3 toward the liquid ejection nozzle 15-4.

Each of the plurality of liquid ejection nozzles 15-4 is formed by a hollow cylindrical through hole (a liquid injection port, a liquid ejection port) 15-4*a* with the diameter being D, being provided in the ceramic sheet 15*a*, one end of which (a liquid injection port, an opening exposed to the liquid injection space) being substantially exposed to the liquid injection space 21, and a series of hollow cylindrical through holes 15-4*b*–15-4*d* formed in each of the ceramic sheets 15*b*–15*d*, respectively, the sizes (diameters) of which becoming larger sequentially (in order) starting from the liquid injection port 15-4*a* toward the chamber 15-2. The axis for each of the liquid ejection nozzles 15-4 is in parallel to the Z-axis. Hereinafter, the diameter D is also to be simply referred to as "nozzle diameter D."

The liquid filling port 15-5 is a space formed by the side wall of the hollow cylindrical through holes provided in the ceramic sheets 15-*d*–15-*f* at the end in the X-axis positive direction of the injection device 15A and at the generally center in the Y-axis direction of the injection device 15A, so that the liquid supply passage 15-1 can communicate with the outside of the injection device 15A. The liquid filling port 15-5 is connected to (communicates with) the upper section of the liquid supply passage 15-1 on a virtual (hypothetical, imaginal) plane located on the boundary plane between the ceramic sheets 15*d* and 15*c*. The upper face of the ceramic sheet 15*b*, i.e., section (portion) of the liquid supply passage 15-1 being opposed to (confronting) this virtual plane is a plane, which is in parallel to the virtual plane.

The shape and the size of each of the chambers 15-2 are additionally described here. When each of the chambers 15-2 is cut at the center (i.e. the flow passage is cut) in its longitudinal direction (Y-axis direction), with the plane (X-Z plane) crossing at right angles the direction in which the liquid flows (liquid flowing direction), thus obtained cross-sectional shape of the flow passage is substantially a rectangle. The length L of the longer axis for the longitudinal-shaped flow passage (i.e. the length L along the Y axis) and the length W of the shorter axis (i.e. the length W along the X axis, and the length W of a side of the rectangle) are 3.5 mm and 0.35 mm, respectively, and the height T (i.e. the length T along the Z axis, and the length T of a side crossing said side of the rectangle at right angles) is 0.15 mm. In other words, in the rectangle which is the shape of the cross-section of the flow passage, the ratio (T/W) of the length (height T) of a side crossing another side having the piezoelectric/electrostrictive element at right angles to the length (shorter axis W) of the side having the piezoelectric/electrostrictive element is 0.15/0.35=0.43, and it is desirable that this ratio (T/W) is larger than 0 and smaller than 1 (i.e. between 0 and 1). If the ratio (T/W) is selected in such a way (i.e. between 0 and 1), the oscillation energy (vibration energy) of the piezoelectric/electrostrictive element 15*g* can be efficiently and promptly transferred to the fuel within the chamber 15-2.

Also, the diameter D of the end portion of the liquid ejection nozzle 15-4 (nozzle diameter D), and the diameter d of the liquid introduction hole 15-3 are designed to be 0.031 mm and 0.025 mm, respectively. In this case, the cross-sectional area S1 (=W×T) of the flow passage of the chamber 15-2 is desirably larger than the sectional area S2 ($=\pi\cdot(D/2)^2$) of the end portion 15-4*a* of the liquid ejection nozzle 15-4, and moreover, larger than the sectional area S3 ($=\pi\cdot(d/2)^2$) of the liquid introduction hole 15-3. Also, for atomizing liquid, the sectional area S2 is desirably larger than the sectional area S3.

Each of the piezoelectric/electrostrictive elements 15*g* is slightly smaller than each of the chambers 15-2 in a plan view (viewed from the Z-axis positive direction), and secured to the upper face of the ceramic sheet 15*f* (wall face including the side of the rectangular (quadrilateral), that is the cross-sectional shape of the flow passage of the chamber 15-2. Each of the elements 15*g* is arranged inside of each of the chambers 15-2 in the plan view. These piezoelectric/electrostrictive elements 15*g* are operated (driven) based on the drive voltage signal DV which is supplied to an electrode-to-electrode (not shown in the drawing) formed on the upper face and on the lower face of each of the piezoelectric/electrostrictive elements 15*g*, by and from a drive voltage signal generation means (circuit) of the electric control unit 30, to deform the ceramic sheet 15*f* (the upper wall of the chamber 15-2), thereby changing the volume of the chamber 15-2 by ΔV.

As to method for forming the ceramic sheets 15*a*–15*f*, and for forming their laminated (layered) body, a method is employed comprising the following steps:

1. a step in which a green ceramic sheet is formed by means of using a powdered zirconia with particles ranging in size from 0.1 to several μm's;
2. a step in which stamping is carried out to the ceramic green sheet by using a metallic molded punch and die to form cut-out sections corresponding to the cuts in the ceramic sheets 15*a*–15*e* shown in FIG. 5 (i.e. cavities for the chamber 15-2, liquid introduction hole 15-3, liquid supply passage 15-1, liquid ejection nozzle 15-4, and liquid filling port 15-5 (see FIG. 4); and 3. a step in which the ceramic green sheets are laminated and compression bonded, then fired at 1550° C. for 2 hours to form a single piece.

On the upper face of a section corresponding to the chamber section of the laminated body of the ceramic sheets manufactured by the method described above, the piezoelectric/electrostrictive element 15*g* having (interposed between) electrodes is formed. With the steps described above, the injection device 5A is manufactured. As described above, when the injection device 15A is formed as a single piece with zirconia ceramics, a high durability can be maintained against frequent deformations of the wall face 15*f* caused by the piezoelectric/electrostrictive element 15*g* due to the characteristics of the zironia ceramics, and the size of the liquid injection device having the plurality of ejection nozzles 15-4, 15-4 . . . can be reduced to be several centimeters in the overall length. In addition, the device can be easily manufactured at low cost.

The injection device 15A described above is secured to an injection device stationary plate 15B, as shown in FIGS. 2 and 3. This injection device stationary plate 15B has a rectangle-shape which is slightly larger than the injection device 15A in a plan view. The injection device stationary plate 15B includes through holes, not shown in the drawings, in the position opposite to each liquid injection port 15-4*a* in the injection device 15A, when securing the injection device 15A, so that each liquid ejection port 15-4*a* is designed to be exposed to the outside through each of the thorough holes. The injection device stationary plate 15B is secured to a retainer unit 15C by being retained at its periphery.

The outside shape of the retainer unit 15C in the plan view is the same as that of the injection device stationary plate 15B, and as shown in FIG. 1, the retainer unit is secured to the intake pipe 20 of the internal-combustion engine at its periphery with bolts which are not shown in the drawings. As shown in FIG. 2, this retainer unit 15C has, at its center, a through hole, the diameter of which is slightly larger than the diameter of the external barrel 14*c* of the electro-magnetic ejection valve 14. The external barrel 14*c* is inserted into this through hole.

As shown in FIGS. 2 and 3, a sleeve (hermetically sealed space forming member) 15D has a cylindrical shape. The internal diameter of the sleeve 15D is equal to the outer diameter of the external barrel 14*c* of the electro-magnetic ejection valve 14, and the outer diameter of the sleeve 15D is equal to the internal diameter of the thorough hole in the retainer unit 15C. One end of the sleeve 15D is closed, and the other end is open. As shown in FIG. 3, at the center of the closed end, an opening 15D-1 is provided, which has almost the same diameter as the liquid filling port 15-5 in the injection device 15A. An O-ring groove 15D-1*a* is formed on the wall face on the inner radius side forming the opening 15D-1. The groove 15D-1*a* is positioned at the outer side of the closed end.

The external barrel 14*c* of the electro-magnetic ejection valve 14 is press-inserted into the sleeve 15D from the open end of the sleeve 15D until it bottoms the inner side of the closed end of the sleeve 15D, and then the sleeve 15D is press-inserted into the thorough hole in the retainer unit 15C. At this time, an O-ring 16 inserted into the O-ring groove 15D-1*a* comes into contact with the ceramic sheet 15*f* of the injection device 15A.

As described above, the electro-magnetic ejection valve 14 and the injecting unit 15 are assembled as a single piece (part), and a hollow cylindrical hermetically sealed space is formed between the ejection hole 14*c*-2 in the electro-magnetic ejection valve 14 (i.e. the leading closed end of the external barrel 14*c* of the electro-magnetic ejection valve 14 in which the ejection hole 14*c*-2 is formed (i.e. the outer side of the closed end) or the section which can be referred to as "an outer side of the ejection hole forming face of the hollow cylindrical external barrel 14*c*") and the liquid filling port 15-5 in the injection device 15A. In this state, the center axis of the opening 15D-1 of the sleeve 15D (the center axis of the hollow cylindrical hermetically sealed space) is aligned with the center axis of the liquid filling port 15-5 in the injection device 15A, and also, aligned with the center axis CL of the needle valve. As described above, the sleeve 15D is placed between the ejection holes 14*c*-2 in the electro-magnetic ejection valve 14 and the liquid filling port (liquid filling section) 15-5 in the injection device 15A, such that a hollow cylindrical hermetically sealed space is formed between the ejection hole 14*c*-2 (the outer side of the leading closed end of the external barrel 14) and the liquid filling port 15-5. The hollow cylindrical hermetically sealed space has substantially the same diameter as that of the liquid filling port 15-5, and the center axis of the hollow cylindrical hermetically sealed space is aligned with the center axes CL of the liquid filling port 15-5 and the needle valve.

Also, as described above, since the ejection hole 14*c*-2 is tilted by angle θ to the axis CL of the needle valve 14*d* (i.e., the axis of the hollow cylindrical hermetically sealed space), as the fuel ejected from the electro-magnetic ejection valve 14 travels closer to the injection device 15A, in the inside of the opening 15D-1 in the sleeve 15D (i.e., in the hollow cylindrical hermetically sealed space), it spreads at angle θ to the axis CL. In other words, a distance between the fuel ejected from the ejection hole 14*c*-2 in the form of droplets of liquid and the center axis CL of the hollow cylindrical hermetically sealed space increases, as a distance from the ejection hole 14*c*-2 to the liquid filling port 15-5 increases.

In this embodiment, the angle θ is determined so that before the fuel thus ejected arrives at a wall face WP, which is formed (is defined) by the inner radius wall face which forms the opening 15D-1 in the sleeve 15D (that is, the hollow cylindrical hermetically sealed space) as well as by means of virtually extending the inner radius wall face (excluding the inner radius wall face of the O-ring groove) till the extended portion crosses a plane section PS of the liquid supply passage 15-1 (the plane section being a portion of the upper face of the ceramic sheet 15*b*) (shown by an imaginary two-point-chain-line in FIG. 3), the fuel can arrive at the plane section PS of the liquid supply passage 15-1.

In other words, the electro-magnetic ejection valve 14 is placed and configured so that the eject flow line (shown by one-point chain line DL in FIG. 3) for the liquid ejected from the ejection hole 14*c*-2 directly crosses the plane section PS of the liquid supply passage 15-1, without crossing the side wall WP which is formed by means of virtually extending the side wall 15D-1 of the hollow cylinder forming the hermetically sealed space in the sleeve 15D to the plane section SP of the liquid supply passage 15-1, or the side wall 15D-1. That is, the liquid ejected crosses neither the virtual side wall WP nor the inner side wall of the opening 15D-1.

Due to the configuration as described above, the fuel, which is ejected from the ejection hole 14*c*-2 in the electro-magnetic ejection valve 14 and supplied to the liquid supply passage 15-1 through the liquid filling port 15-5, is then introduced into each of the chambers 15-2 through each liquid introduction hole 15-3. And after being given an oscillation energy in the individual chambers 15-2, the fuel is injected through the liquid ejection nozzle 15-4, and from the liquid injection port 15-4*a*, into the intake pipe 20 in the form of atomized droplet, through the through hole in the injection device stationary plate 15B.

As shown in FIG. 1, the electric control unit 30 is connected to an engine rotational speed sensor 31 and an intake pipe pressure sensor 32, and is configured in such a manner as to determine the fuel amount required for the internal-combustion engine, after obtaining the engine rotational speed N and the intake pipe pressure P from these sensors, and send out (supply) a high-level signal (signal for opening the valve) as the valve drive signal INJ for the time corresponding to the fuel amount. By this configuration, the needle valve 14*d* of the electromagnetic ejection valve 14 is forced to move in response to the high-level signal so as to open the ejection hole 14*c*-2 to eject the fuel from the ejection hole 14*c*-2.

In addition, the electric control unit 30 has a built-in drive signal generation circuit for supplying a drive voltage signal DV of a frequency f (a driving frequency with period T=1/f) to between electrode-to-electrode (electrodes, not shown) for the piezoelectric/electrostrictive element 15*g*. In this case, the driving frequency f is set to be equal to the resonance frequency (specific oscillation frequency) of the injection device 15A. The resonance frequency is determined by the structure of the chamber 15-2, the structure of the liquid ejection nozzle 15-4, the nozzle diameter D, the introduction hole diameter d, the shape of the section causing deformation in the ceramic sheet 15*f* by the piezoelectric/electrostrictive element 15*g*, and types of the liquid. For example, the driving frequency is set to around 50 kHz.

Figure 6:
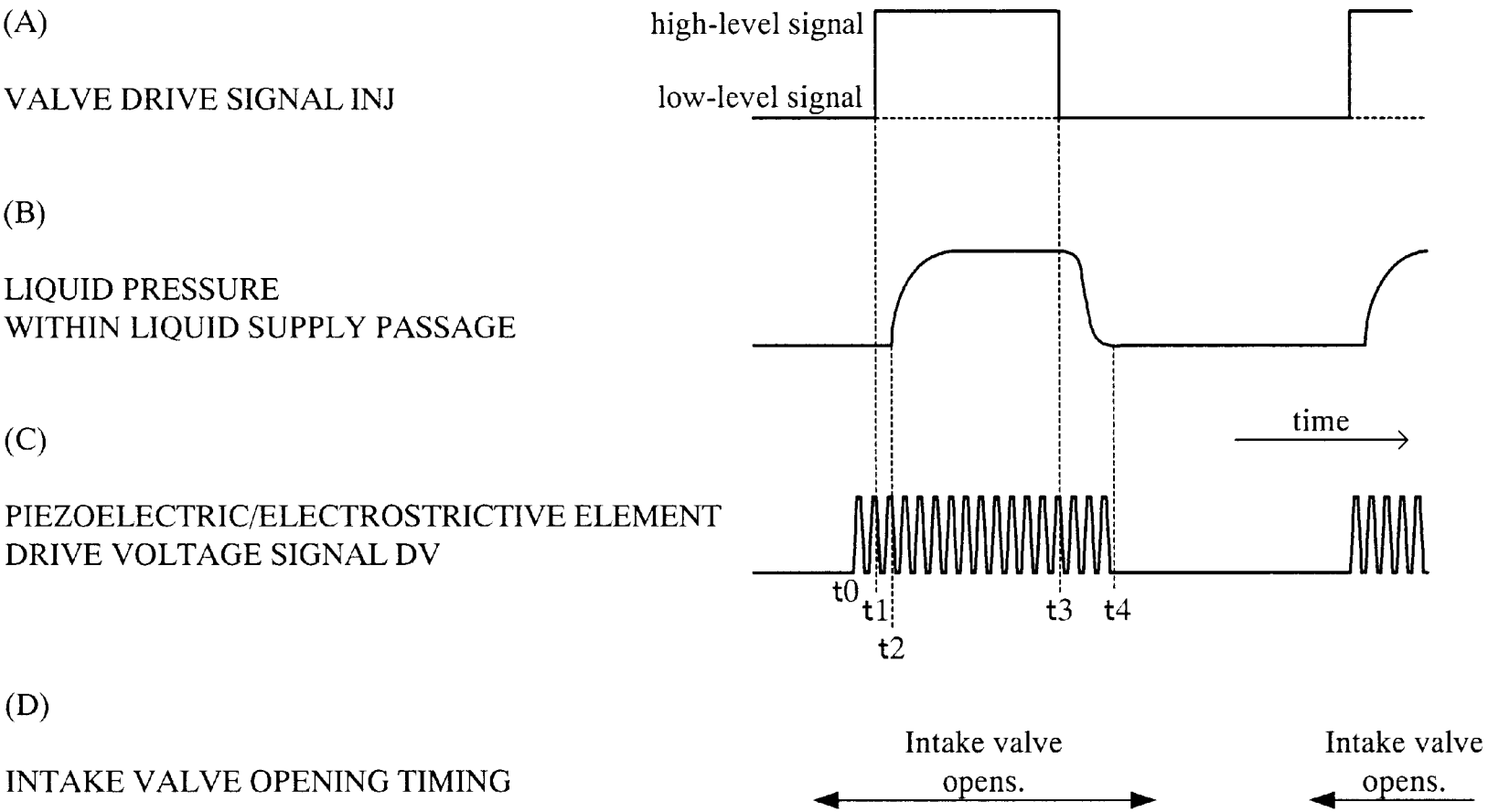
FIG. 6 is a timing chart in which (A), (B), (C) and (D) show an valve drive signal to be added to the electromagnetic ejection valve, the liquid pressure within a liquid supply passage, a drive voltage signal to be added to a piezoelectric/electrostrictive element, and an valve opening timing for an intake valve, respectively.
Figure 7:
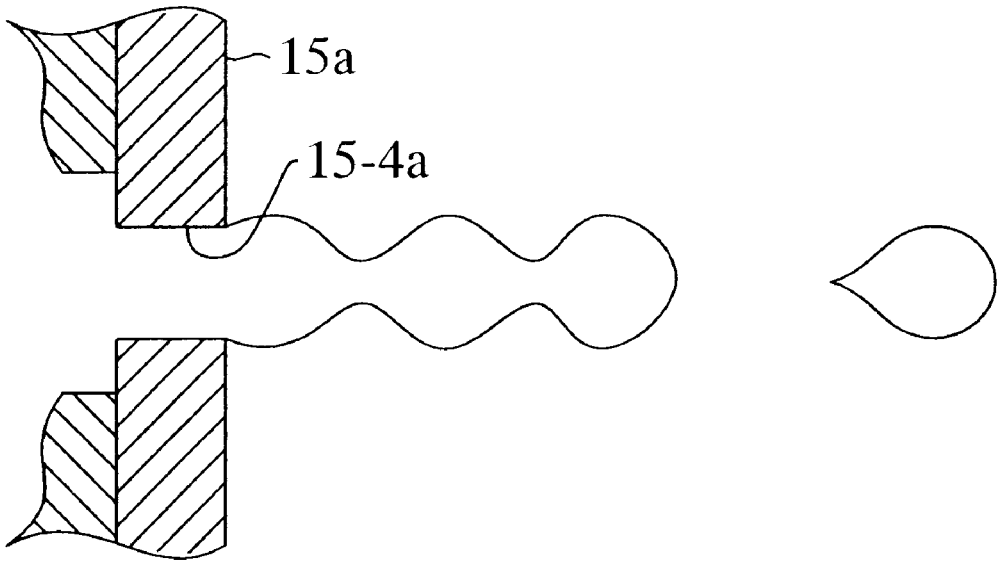
FIG. 7 shows the state of the liquid to be injected from the liquid injection apparatus according to the present invention as shown in FIG. 1.

Here, referring to FIG. 6, the time-relationship between the valve drive signal INJ and the drive voltage signal DV is described. The electric control unit 30 starts applying the drive voltage signal DV to the piezoelectric/electrostrictive element 15*g*, at the time T1 which is the same as the time t1 when the valve drive signal INJ to the electro-magnetic ejection valve 14 rises (changes from a low-level signal to a high-level signal), or alternatively, at the time t0 immediately before the time t1, and the unit 30 continues the application of the drive voltage signal DV to the piezoelectric/electrostrictive element 15*g* until the time t4, which is only the specified time behind the time t3 when the valve drive signal INJ to the electro-magnetic ejection valve 14 falls (changes from a high-level signal to a low-level signal), and (the time t4 being the time) when the pressure of the liquid within the liquid supply passage 15-1 drops to (becomes equal to) the steady-state pressure during the electro-magnetic ejection valve 14 is in the closed state. The unit 30 ends the application of the drive voltage signal DV at the time t4.

Next, operations of the thus configured liquid injection apparatus are described below. The electric control unit 30 determines the valve drive signal INJ (the length of a high-level signal), based on the engine running state, such as the engine rotational speed N and the intake pipe pressure P, and also determines the timing (time t1 noted in FIG. 6) to output the valve drive signal INJ. In addition, when the time t0, which is only the specified time earlier than the time t1, comes, the electric control unit 30 starts adding (supplying) the drive voltage signal DV with the frequency f to the electrode-to-electrode for the piezoelectric/electrostrictive element 15*g*, and supplies the valve drive signal INJ to the electro-magnetic ejection valve 14 at the time t1.

When the time t2 comes, which is slightly later than the time t1, (in other words, when the invalid injecting time of the electro-magnetic ejection valve elapses), the ejection hole 14*c*-2 is opened because the needle valve 14*d* is moved, and from the ejection hole 14*c*-2, the apparatus starts ejecting and supplying the fuel in the fuel passage 14*b* into the liquid supply passage 15-1 in the injection device 15A, through the hollow cylindrical hermetically sealed space in the sleeve 15D and the liquid filling port 15-5 in the injection device 15A. As a result, the pressure of the liquid within the liquid supply passage 15-1 starts rising, as shown in FIG. 6 (B).

After the time t2, when the pressure of the fuel in the chamber 15-2 rises up to the sufficient pressure, the fuel is pushed out (injected) toward the liquid injection space in the intake pipe 20, from the end face of the liquid injection port 15-4*a*. At this time, since an oscillation energy caused by the operation of the piezoelectric/electrostrictive element 15*g* is added to the fuel in the chamber 15-2, a constricted area is formed in the injected fuel. Therefore, the fuel is separated from the constricted area as if being torn off at its leading end. As the result of this, the equally and finely atomized fuel is injected into the intake pipe 21.

In this case, the apparatus is configured so that the ratio (V/Q) is 0.03 or less, where Q (cc/minute) represents the eject amount (eject flow rate) per unit time of the liquid ejected from the electro-magnetic ejection valve 14, and V (cc) represents the volume of the liquid flow passage formed from the electromagnetic ejection valve 14 (a leading end of the ejection holes 14*c*-2) to the leading end of the liquid ejection nozzle 15-4 of the injection device 15A.

Here, the volume V means the total volume of the hollow cylindrical hermetically sealed space formed by the sleeve 15D, liquid filling port 15-5, liquid supply passage 15-1, chambers 15-2, liquid introduction holes 15-3, and liquid ejection nozzles 15-4.

As shown in FIG. 6, this embodiment sets the time when the valve drive signal INJ is a high-level signal, so that this time is only within the time when the intake valve 22 in the internal-combustion engine is in the open state. In other words, when the fuel injected by the liquid injection apparatus 10 arrives at the intake valve 22, the intake valve 22 has already been in the open state, so that the fuel is directly sucked up into the cylinder without attaching (adhering) to the rear (back) face of the intake valve 22. Thus, since the atomized and injected fuel is directly sucked up into the cylinder, there is no or little possibility of the fuel attaching (adhering) to the wall face of the intake valve 22 or intake pipe 20 and the like. Therefore, the fuel consumption of the internal-combustion engine can be improved, and the amount of unburned gas contained in the emission can be reduced.

Preferably, the velocity of the atomized fuel (droplets of liquid, sprayed droplets) injected from the liquid ejection nozzle 15-4 is varied with respect to the lift amount of the intake valve 22, and/or the suction flow velocity (wind velocity) in the intake pipe 20. According to such a preferable embodiment, it is more likely that the atomized and injected fuel can be directly sucked up into the cylinder without attaching to the wall face. The velocity of the atomized fuel injected from the liquid ejection nozzle 15-4 can be varied, by means of varying the waveform of the drive voltage signal DV to the piezoelectric/electrostrictive element 15*g* (particularly, the rising speed of the signal DV, or the maximum voltage of the signal DV), or by varying the pressure of the fuel (fuel pressure) to be supplied to the electro-magnetic ejection valve 14. The fuel pressure can be changed, by means of varying the regulation pressure of the pressure regulator 13, or varying the eject pressure of the pressurizing pump if the pressure regulator 13 is not provided.

As described above, according to the liquid injection apparatus with respect to the embodiment of the present invention, since the fuel is pressurized by the pressurizing pump 11, and the fuel is injected into the liquid injection space 21 in the intake pipe 20 due to the pressure, the apparatus can stably inject the intended amount of fuel, even if the pressure in the liquid injection space 21 (suction pressure) changes.

In addition, oscillation energy is given to the fuel by the volume change of the chamber 15-2 in the injection device 15A, and the fuel is injected from the liquid ejection nozzle 15-4, with being atomized. As a result, the liquid injection apparatus can inject extremely finely atomized droplets of liquid. Moreover, as the injection device 15A comprises a plurality of chambers 15-2 and a plurality of ejection nozzles 15-4, even if air bubbles are formed in the fuel, the air bubbles are easily divided finely. As a result, significant fluctuation in the amount of injection caused by the presence of air bubbles can be avoided.

Also, since the direction in which the fuel is ejected from the ejection hole 14*c*-2 is determined, such that the distance of the fuel ejected from the ejection hole 14*c*-2 from the center axis CL of the hollow cylindrical hermetically sealed space increases, as the distance from the ejection hole 14*c*-2 in the electro-magnetic ejection valve 14 to the liquid supply passage 15-1 along the center axis CL increases, the flow of the ejected fuel is produced in a wide area in the hollow cylindrical hermetically sealed space. As a result, air bubbles are hardly formed, especially at corners in the vicinity of the ejection hole 14*c*-2 of the electro-magnetic ejection valve 14 in the hermetically sealed space (marked by blackened triangle in FIG. 3), or removal performance to remove (exclude) air bubbles generated (formed) at the corners is improved. Therefore, in this liquid injection apparatus, since the rise of the fuel pressure is hardly hindered by air bubbles, the pressure of the fuel can be increased as expected, thereby enabling the apparatus to inject the required amount of injection of droplets of the fuel at the required injection timing, according to the requirements of mechanical apparatuses including the internal-combustion engine.

Further, the above-mentioned liquid injection apparatus is configured such that by the time when liquid ejected from the electro-magnetic ejection valve 14 is eventually injected from the ejection nozzle 15-4 into the liquid injection space 21, a flow of the liquid is bent at substantially right angles at least once (in this embodiment, 4 times).

That is, in this liquid injection apparatus, the flow of the liquid ejected from the electro-magnetic ejection valve 14 is first bent at right angles at the joint section of the liquid filling port 15-5 and the liquid supply passage 15-1, as the liquid filling port 15-5 crosses the liquid supply passage 15-1 at right angles. Next, the flow of the liquid is bent at right angles at the joint section of the liquid supply passage 15-1 and the liquid introduction hole 15-3, as the longer axis direction of the liquid supply passage 15-1 is in parallel with the X axis, and the center axis of the liquid introduction hole 15-3 is in parallel with the Z axis.

Moreover, since the longer axis of the chamber 15-2 is in parallel with the Y axis, and the center axis of the liquid introduction hole 15-3 is in parallel with the Z axis, the flow of the liquid is bent at right angles at the joint section of the chamber 15-2 and the liquid introduction hole 15-3. Also, since the longer axis of the chamber 15-2 is in parallel with the Y axis, and the axis of the liquid ejection nozzle 15-4 is in parallel with the Z axis, the flow of the liquid is again bent at right angles at the joint section of the chamber 15-2 and the liquid ejection nozzle 15-4.

In such configurations as described above, since the flow of the liquid ejected from the electro-magnetic ejection valve 14 is bent at substantially right angles at least once, pulsation of the liquid pressure caused by opening of the electro-magnetic ejection valve 14 can be reduced (attenuated), and thereby the apparatus can stably inject droplets of liquid. In other words, the dynamic pressure of the liquid caused by opening of the electromagnetic ejection valve 14 becomes the static pressure, and the fuel is injected under this static pressure. As a result, the fuel can be stably injected from each ejection nozzle.

Especially, this liquid injection apparatus comprises a plurality of chambers 15-2, which are connected to the liquid supply passage 15-1 in common to chambers 15-2, and furthermore, the apparatus is configured such that the flow of the liquid ejected from the electro-magnetic ejection valve 14 is bent at generally right angles at the joint section of a liquid filling port 15-5 and the liquid supply passage 15-1. Thus, it is possible to stabilize the pressure of the liquid within the liquid supply passage 15-1 and therefore within the chambers 15-2. Accordingly, droplets of liquid ejected from each of ejection nozzles 15-4, 15-4 . . . connected to each of the chambers 15-2, 15-2 . . . can be made uniform, since the pressure of the liquid in each of the chambers 15-2, 15-2 . . . becomes the static pressure and thus stabilized.

In addition, the electro-magnetic ejection valve 14 is arranged and configured such that the ejected flow line of the liquid (fuel) (shown by 1-point chain line DL in FIG. 3) directly crosses the plane section PS of the liquid supply passage 15-1, without crossing a side wall WP which is formed by the side wall of the opening 15D-1 forming the hollow cylindrical hermetically sealed space in the sleeve 15D, or a side wall WP defined by means of virtually extending the side wall of the opening 15D-1 down to the plane section PS of the liquid supply passage 15-1 (the upper face of the ceramic sheet 15*b*).

As the result of this configuration and arrangement, since the liquid ejected from the electro-magnetic ejection valve 14 arrives at the plane section SP of the liquid supply passage 15-1 with keeping its kinetic energy (flow velocity) in high state, the liquid is strongly reflected, on this plane section PS, to the side of the ejection hole 14*c*-2 in the hollow cylindrical hermetically sealed space. As the result of this reflection, the flow of the reflected liquid can remove (exclude) air bubbles staying at the corners (shown by blackened triangle in FIG. 3) in the vicinity of the ejection hole 14*c*-2 in the hollow cylindrical hermetically sealed space, thereby reducing the amount of air bubbles in the liquid. Due to this reduction, in this liquid injection apparatus, the pressure rise of the liquid is more hardly hindered by air bubbles, and the pressure of the liquid can be increased as expected. Therefore, this enables the apparatus 10 to inject the required amount of injection of droplets of liquid at the required injection timing, as the internal-combustion engine requires.

Also, as the apparatus is configured such that the ratio (V/Q) is 0.03 or less, where Q represents the eject amount (eject flow rate) (cc/minute) of the liquid ejected from the electro-magnetic ejection valve 14 per unit time, and V represents the volume (cc) of the liquid flow passage formed from the electromagnetic ejection valve 14 to the leading end of the ejection nozzle 15-4 in the injection device 15A, the volume V does not become excessively large relatively to the eject flow rate. Therefore, since the time period until the pressure of the liquid within the ejection nozzle 15-4 in the injection device 15A starts rising, from the electromagnetic ejection valve 14 started ejecting the liquid, can be shortened, the apparatus can inject droplets of liquid at the intended timing.

Furthermore, the above-mentioned liquid injection apparatus advances the start of generating the drive voltage signal DV than the start of generating the valve drive signal INJ, and at the same time, it retards the end of the drive voltage signal DV than the end of the valve drive signal INJ. As the result of this, since oscillation energy is always given to the fuel to be injected, the apparatus could securely inject the atomized fuel even at the injecting start time or ending time, and in addition, power consumption could be reduced, because the apparatus generates the drive voltage signal only when required.

Moreover, as the axis of the individual liquid ejection nozzle 15-4 is in parallel to the Z-axis, the droplets of liquid ejected from the ejection nozzles 15-4 to the liquid injection space 21 will not substantially cross each other while flying, and will not become larger droplets of liquid by coming into collision with each other in the liquid injection space 21. Due to the reasons, satisfactory fuel spray in equally atomized state can be embodied.

In the above-mentioned embodiment, the strength of oscillation to be given to the fuel varies depending on the potential difference to be added to between the electrode-to-electrode, not shown in the drawing, provided on the upper face and the lower face of the piezoelectric/electrostrictive element 15*g* (i.e., the maximum voltage of the drive voltage signal DV, the strength of the electric field to be added to the piezoelectric/electrostrictive element 15*g*), or the thickness of the ceramic sheet 15*f* (the upper wall) of the chamber 15-2. In this embodiment, it is designed that the ratio V/ΔV (i.e., chamber volume/amount of volume change) is 1500, where ΔV denotes the amount of the volume change of the chamber 15-2, obtained by means of deforming the ceramic sheet 15*f* by the operation of the piezoelectric/electrostrictive element 15*g*, and V denotes the volume of the chamber 15-2. Here, the value of this ratio V/ΔV is preferably 2 or more and 3000 or less, and particularly, 2 or more and 1500 or less.

This is because if the value of the ratio (chamber volume/amount of volume change) exceeds 3000, the energy amount of oscillation to be transferred to the liquid within the chamber 15-2 is reduced (is too small), and sufficient atomizing of the fuel cannot be embodied. On the other hand, if the value of the ratio (chamber volume/amount of volume change) is smaller than 2, the pressure of the liquid within the chamber 15-2 significantly fluctuates, thereby causing the eject amount (injecting flow rate) to be unstable, and especially, if the liquid is a volatile liquid, such as gasoline fuel, it becomes difficult to inject stably the liquid because of the large amount of air bubbles formed in the liquid.

With the above-mentioned conditions, the droplet diameter of the gasoline injected is 30 μm, equal size, thereby resulting in the improvement of fuel consumption and reduction of toxic emission.

In the liquid injection apparatus of the above embodiment, an experiment was conducted for studying the relationship among the nozzle diameter D in the injecting unit 15 (injection device 15A), the introduction hole diameter d, and the droplet ejecting state. In the experiment, the injection device 15A was used, in which the length L of the longer axis of the chamber 15-2 being 3.5 mm, and the length W and the height T of sides of the cross-section of the chamber 15-2 are 0.35 mm and 0.15 mm, respectively, and as the ejecting liquid, gasoline was used. Also, at the time of injecting (at the time of ejecting), the pressure of the liquid within the chamber 15-2 was increased up to 0.1 Mpa, and at the same time, the drive voltage signal DV with the driving frequency 45 kHz, and the maximum voltage V0 of the signal being 20V was supplied to the piezoelectric/electrostrictive element 15*g*. The following table 1 shows the result of the experiment. In the experiment, the state in which the size of the droplet was smaller than the nozzle diameter D at the position which was only 5 mm away from the end portion of the liquid injection port 15-4*a* to the side of the injecting space, and injecting was conducted stably was considered to be a satisfactory ejecting state (in the Table 1, shown by "○"), and the other cases were considered to be fault (in the Table 1, shown by "X").

TABLE 1

| Sample Name | Nozzle Diameter D (mm) | Introduction hole Diameter d (mm) | Nozzle Diameter/ Introduction hole Diameter (D/d) | Eject State |
|---|---|---|---|---|
| Sample 1 | 0.031 | 0.005 | 6.200 | ×(No stability) |
| Sample 2 | 0.031 | 0.007 | 4.429 | ○ |
| Sample 3 | 0.031 | 0.025 | 1.240 | ○ |
| Sample 4 | 0.025 | 0.031 | 0.806 | × (No stability) |
| Sample 5 | 0.031 | 0.031 | 1.000 | × |
| Sample 6 | 0.050 | 0.007 | 7.143 | × |
| Sample 7 | 0.050 | 0.025 | 2.000 | ○ |

As can be seen from Table 1, when the ratio of the nozzle diameter D to the introduction hole diameter d (D/d) became larger than 6.200, stable injecting was not conducted (see Sample 1). The reason for this is thought that if the introduction hole diameter d is excessively smaller than the nozzle diameter D, the flow passage resistance at the liquid introduction hole 15-3 becomes excessive, thus the liquid amount flowing into the chamber 15-2 becomes insufficient. Therefore, desirably, the ratio D/d must be smaller than 6.200, (preferably smaller than 5.000, or more preferably, smaller than 4.429 (see Sample 2)).

Also, understood from Table 1, when the ratio D/d was smaller than 1.000, stable eject was not performed (see Sample 5). The reason for this is thought that because the introduction hole diameter d is excessively larger than the nozzle diameter D, oscillation (oscillation energy) of the piezoelectric/electrostrictive element 15*g* added to the liquid was absorbed up in (on the side of) the liquid supply passage 15-1 through the liquid introduction hole 15-3, thus the oscillation (oscillation energy) failed to be sufficiently added to the liquid to be injected from the chamber 15-2 through the ejection nozzle 15-4.

Therefore, in order to allow the oscillation of the piezoelectric/electrostrictive element 15*g* to be sufficiently transferred to the liquid to be injected, the apparatus is advantageously configured such that the ratio D/d is larger than 1.000 (preferably larger than 1.240), in other words, the area of the cross-section at one end of the liquid eject nozzle 15-4 which is exposed to the liquid injection space, defined by the nozzle diameter D (cross-sectional area of the liquid injection port 15-4*a*) is larger than the cross-sectional area of the liquid introduction hole 15-3 defined by the introduction hole diameter d.

By this configuration, the oscillation energy of the piezoelectric/electrostrictive element 15*g* to be added to the liquid within the chamber 15-2 is hardly attenuated in the liquid supply passage 15-1 through the liquid introduction hole 15-3, thus the oscillation energy is efficiently transferred to the liquid to be injected from one end of the ejection nozzle 15-4*a*, so that the liquid can be securely atomized.

When similar experiments were conducted by means of using a variety of values for the nozzle diameter D, the experiments showed that the nozzle diameter D is desirably smaller than 0.1 mm, and more desirably 0.02–0.04 mm. This is because if the nozzle diameter D is larger than 0.1 mm, atomizing of the droplets of liquid to be injected becomes difficult, or if the nozzle diameter D is smaller than 0.02 mm, dirt or dust included in the liquid (fuel) is easily clog the liquid injection port 15-4, thereby causing practical utility to be impaired.

Figure 8:
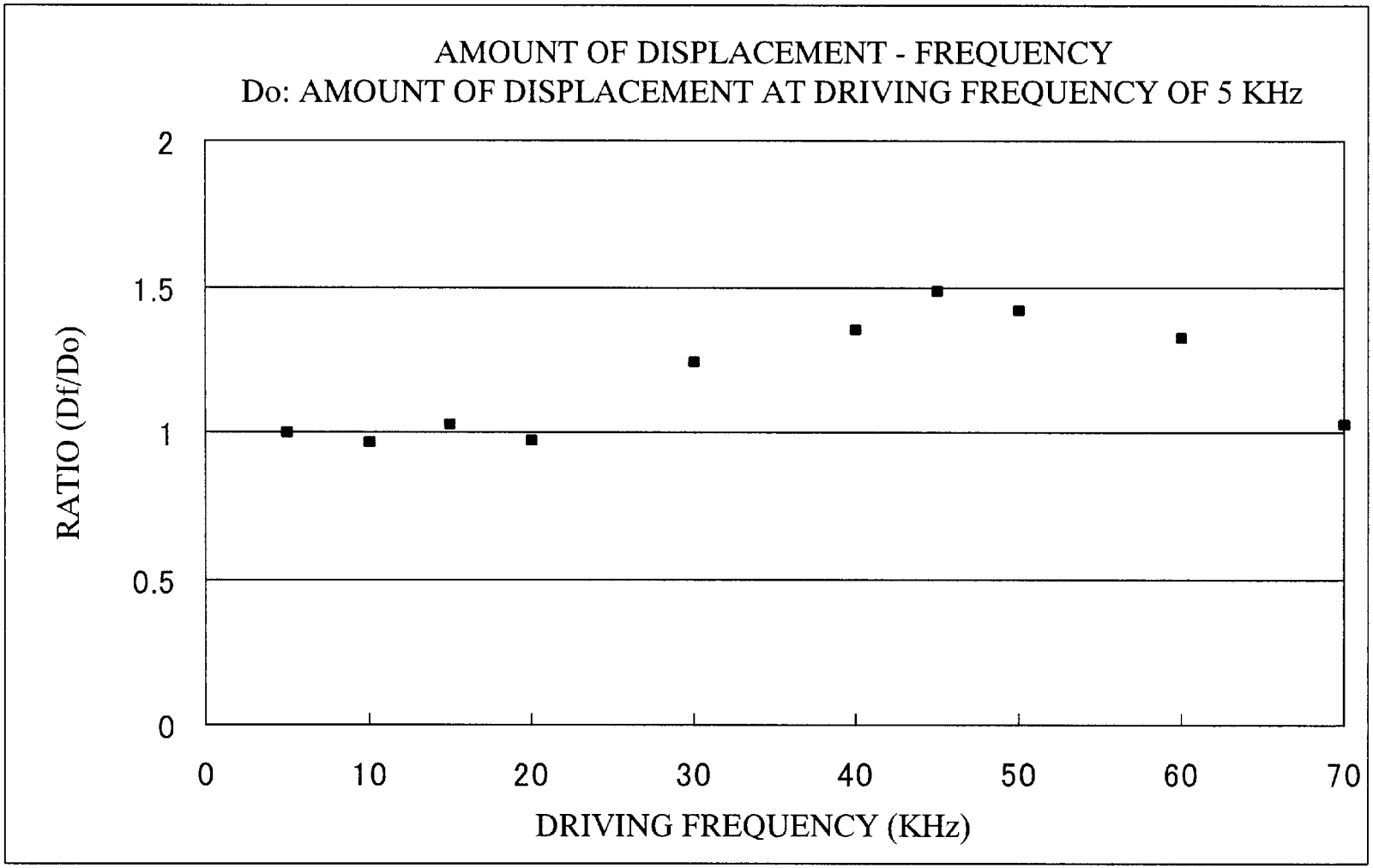
FIG. 8 is a graph showing the change in the amount of displacement of the piezoelectric/electrostrictive element when the frequency of the drive voltage signal to be added to the piezoelectric/electrostrictive element is changed.

Furthermore, in the embodied liquid injection apparatus, studies were made by means of giving the potential difference in the form of a sinusoidal wave (a sine wave) with a frequency f (a drive voltage signal of a driving frequency f=1/T, period T) to between the electrode-to-electrode for the piezoelectric/electrostrictive element 15*g*, to examine the maximum amount of displacement of the piezoelectric/electrostrictive element 15*g* (in FIG. 5, the maximum amount of displacement in the Z axis direction of the piezoelectric/electrostrictive element 15*g*). FIG. 8 shows the result of the experiment. Here, the vertical axis shown in FIG. 8 denotes the ratio (Df/Do) of the maximum amount of displacement Df of the piezoelectric/electrostrictive element 15*g* at each driving frequency f, to the maximum displacement Do of the piezoelectric/electrostrictive element 15*g* when a driving frequency f is 5 kHz.

As shown in FIG. 8, the ratio (Df/Do) becomes the largest, when a driving frequency f is in the vicinity of 50 kHz. The frequency in the vicinity of 50 kHz equals the resonance frequency (intrinsic oscillation frequency) of the injection device 15A defined by the structure of the chamber 15-2, the structure of the liquid ejection nozzle 15-4, the nozzle diameter D, the introduction hole diameter d, the shape of the section which causes deformation of the ceramic sheet 15*f* of the piezoelectric/electrostrictive element 15*g*, and types of the liquid. In other words, the experiments show that by means of allowing the driving frequency f of the drive voltage signal DV to be equal to the frequency in the vicinity of the resonance frequency of the injection device 15A (injecting unit 15), the piezoelectric/electrostrictive element 15*g* can produce larger oscillation, even if the amplitude of the drive voltage signal DV is the same, and the pressure of the liquid can be heavily oscillated with a furthermore smaller energy. The findings show that, in the liquid injection apparatus according to the present invention, desirably, the driving frequency f of the piezoelectric/electrostrictive element 15*g* is set to 0.7 to 1.3 times of the frequency (resonance frequency) which is in the vicinity of the resonance frequency of the injection device 15A (i.e., within ±30% of the resonance frequency), and if the driving frequency f is set as described above, the wall face of the injection device (injecting unit) can be oscillated heavily with less energy, thus the liquid injection apparatus can be reduced its energy consumption.

Figure 9:
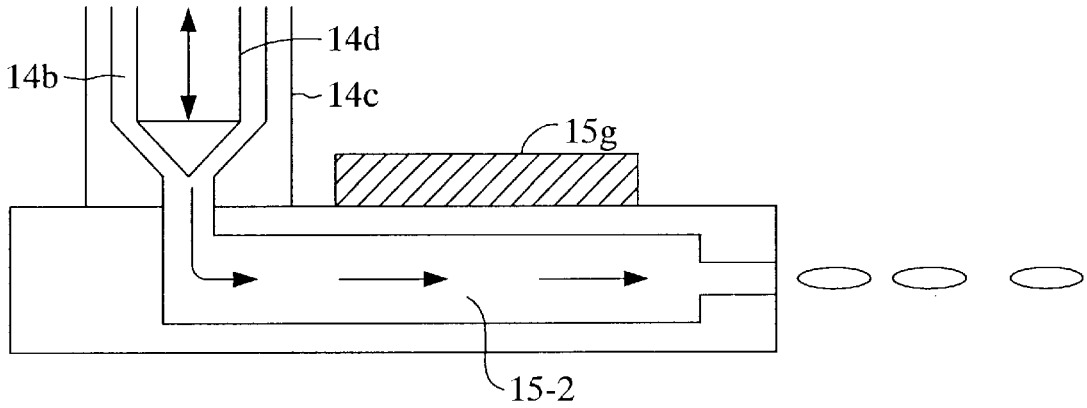
FIG. 9 is a conceptual diagram showing the flow of the liquid in a modified embodiment of the liquid injection apparatus shown in FIG. 1.
Figure 10:
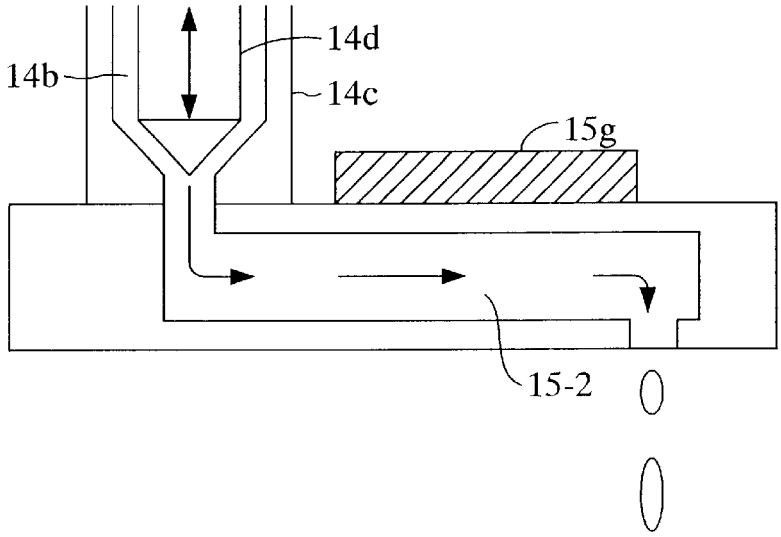
FIG. 10 is a conceptual diagram showing the flow of the liquid in another modified embodiment of the liquid injection apparatus shown in FIG. 1.

As described above, by the liquid injection apparatus according to the present invention, the fuel as liquid cab be finely atomized into uniform sizes and injected at the liquid injection space. The present invention is not limited to the above-mentioned embodiment, but a variety of modified embodiments can be employed within the coverage of the present invention. For example, the above-mentioned embodiment is configured such that the flow of the liquid is bent 4 times at generally right angles by the time when the liquid ejected from the electromagnetic ejection valve 14 is injected to the liquid injection space 21 from the ejection nozzle 15-4, however, as shown in FIG. 9, the flow of the liquid may be bent only once at generally right angles, or as shown in FIG. 10, the flow of the liquid may be bent only twice at generally right angles. Also, the liquid injection apparatus according to the above-mentioned embodiment was applied to the internal-combustion engine, but it can be applied to other mechanical apparatuses, which form their material with atomized droplets of raw material of a liquid.

The liquid injection apparatus according to the above-mentioned embodiment was applied to the gasoline internal-combustion engine of the type for injecting fuel into the intake pipe (suction port), however, it is also effective to apply the droplet injecting apparatus according to the present invention to the so-called "direct injection type gasoline internal combustion engine" which directly injects the fuel into the cylinder. In other words, if the fuel is directly injected into the cylinder with the electrically controlled fuel injection apparatus using the conventional fuel injector, the fuel can be built-up between the cylinder and the piston (in the crevice), and there are some cases in which the amount of incompletely combusted HC (hydrocarbon) increased. On the contrary, when the fuel is directly injected into the cylinder, by means of using the liquid injection apparatus according to the present invention, as the fuel is injected into the cylinder in the atomized state, the amount of the fuel attaching (adhering) to the wall face in the cylinder can be reduced, or the amount of fuel entering the crevice located between the cylinder and the piston can be reduced, thereby leading up to the reduction in the eject amount of incompletely combusted HC.

It is also effective to use the droplet injecting apparatus according to the present invention as the direct injection injector for the diesel engine. In other words, in the conventional injector, there is the problem that the atomized fuel cannot be injected, because the fuel pressure is low especially when the engine is in the low-loaded state. In such a case, if a common-rail injection apparatus is used, the pressure of the fuel can be increased to some extent even when the engine rotational speed is low, and atomizing of the injecting fuel can be accelerated, but the fuel pressure is still low compared to that when the engine rotational speed is high, and the fuel cannot be sufficiently atomized. On the contrary, since the liquid injection apparatus according to the present invention atomizes the fuel by the operation of the piezoelectric/electrostrictive element 15*g*, the apparatus can inject the fuel in the sufficiently atomized state, regardless of the loaded state of the engine (i.e., even if the engine is in the low-loaded state).

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A liquid injection apparatus comprising:

an injection device including a liquid ejection nozzle having one end exposed to a liquid injection space, a piezoelectric/electrostrictive element, a chamber connected to the other end of said liquid ejection nozzle, said chamber having a volume that is changed by an operation of said piezoelectric/electrostrictive element, a liquid supply passage connected to said chamber, and a hollow cylindrical liquid filling port allowing said liquid supply passage to communicate with the exterior;

pressurizing means for pressurizing a liquid;

an electromagnetic ejection valve to which liquid pressurized by said pressurizing means is supplied, said electromagnetic ejection valve including a solenoid valve and an ejection hole which is opened or closed by said solenoid valve, wherein said electromagnetic ejection valve ejects said pressurized liquid through said ejection hole when said solenoid valve is opened; and a hermetically sealed space forming member for forming a hollow cylindrical hermetically sealed space between said ejection hole of said electromagnetic ejection valve and said liquid filling port of said injection device, said hermetically sealed space having a diameter that is substantially the same as a diameter of said liquid filling port;

wherein liquid ejected from said electromagnetic ejection valve is atomized by a change of volume of said chamber and injected in the form of droplets from said liquid ejection nozzle into said liquid injection space; and wherein said electromagnetic ejection valve is configured to eject said liquid from said ejection hole in a direction having a predetermined angle relative to a center axis of said hollow cylindrical hermetically sealed space, such that the distance of said liquid from said center axis increases accordingly as the distance from said ejection hole toward said liquid filling port increases.

2. The liquid injection apparatus according to claim 1, wherein said predetermined angle is in a range of at least 5°to 30°.

3. The liquid injection apparatus according to claim 1, wherein a flow of the liquid is bent at substantially right angles at least once by the time when the liquid ejected from said electro electromagnetic ejection valve is injected through said ejection nozzle into said liquid injection space.

4. The liquid injection apparatus according to claim 1, wherein said liquid supply passage includes a plane section which opposes a virtual plane defined by a section at which said liquid supply passage is connected to said liquid filling port, said plane section extending in a parallel direction with said virtual plane; and wherein said electromagnetic ejection valve is arranged such that an ejection flow line of said liquid ejected from said ejection hole intersects said plane section of said liquid supply passage without intersecting a side wall of the hollow cylindrical hermetically sealed space formed by said hermetically sealed space forming member or a side wall created by virtually extending said side wall of said hermetically sealed space up to said plane section of said liquid supply passage.

5. The liquid injection apparatus according to claim 1, wherein a ratio (V/Q) is 0.03 or less, wherein V represents a volume (cc) of a liquid flow passage extending from said electromagnetic ejection valve up to the leading end of said ejection nozzle of said injection device, and wherein Q represents a quantity of liquid ejection per unit time (cc/minute) of said liquid ejected from said electromagnetic ejection valve.

6. The liquid injection apparatus according to claim 1, wherein said injection device comprises a plurality of said liquid ejection nozzles configured such that the directions of injection of liquid droplets injected from said plurality of liquid ejection nozzles are parallel to each other.

* * * * *

UNITED STATES PATENT AND TRADEMARK OFFICE

CERTIFICATE OF CORRECTION

PATENT NO. : 6,739,520 B2
DATED : May 25, 2004
INVENTOR(S) : Takao Ohnishi and Toshikazu Hirota It is certified that error appears in the above-identified patent and that said Letters Patent is hereby corrected as shown below:

Title page,
Item [57], ABSTRACT,
Line 1, replace “a liquid” with -- Liquid --; delete “10 comprises” and add -- including -- after “apparatus”
Line 2, delete “15”; delete “14”
Line 5, delete “hollow cylindrical”
Line 6, delete the second occurrence of “liquid”
Line 7, delete “liquid”
Line 8, delete “means of”

Column 22,
Line 2, delete “electro”

Signed and Sealed this

Twentieth Day of July, 2004

JON W. DUDAS
*Acting Director of the United States Patent and Trademark Office*